US005143904A

United States Patent [19]

Minato et al.

[11] Patent Number: 5,143,904

[45] Date of Patent: Sep. 1, 1992

[54] THERMAL TRANSFER DYE IMAGE-RECEIVING SHEET

[75] Inventors: Toshihiro Minato; Masaru Kato, both of Tokyo; Kenji Yasuda, Yachiyo; Norio Yamamura, Yokohama; Masahiro Kamiya, Tokyo, all of Japan

[73] Assignee: Oji Paper Co., Ltd, Tokyo, Japan

[21] Appl. No.: 552,270

[22] Filed: Jul. 13, 1990

[30] Foreign Application Priority Data

| | | | |
|---|---|---|---|
| Jul. 18, 1989 | [JP] | Japan | 1-183635 |
| Oct. 30, 1989 | [JP] | Japan | 1-279767 |
| Oct. 30, 1989 | [JP] | Japan | 1-279768 |
| Dec. 14, 1989 | [JP] | Japan | 1-322644 |

[51] Int. Cl.[5] ..... B41M 5/035; B41M 5/26

[52] U.S. Cl. ..... 503/227; 428/195; 428/211; 428/212; 428/215; 428/216; 428/409; 428/478.8; 428/511; 428/513; 428/514; 428/913; 428/914

[58] Field of Search ..... 8/471; 428/195, 913, 428/914, 211–213, 215, 216, 332, 334–336, 409, 412, 474.4, 478.8, 480, 500, 511, 513, 514, 522, 523; 503/227

[56] References Cited

U.S. PATENT DOCUMENTS

| | | | |
|---|---|---|---|
| 4,774,224 | 9/1988 | Campbell | 503/227 |
| 4,778,782 | 10/1988 | Ito et al. | 503/227 |

*Primary Examiner*—B. Hamilton Hess
*Attorney, Agent, or Firm*—Armstrong & Kubovcik

[57] ABSTRACT

A dye image-receiving sheet for thermal transfer printing systems, comprising a substrtate sheet composed of a support paper sheet, a front coated layer comprising a thermoplastic resin, and optionally, a back coated layer comprising a thermoplastic resin; and a dye image-receiving layer comprising a resinous material capable of being dyed with a sublimating dye, and characterized in that the front coating layer has a Bekk smoothness of 100 seconds or more and the substrate sheet has a rigidity of 700 mgf or less.

12 Claims, 1 Drawing Sheet

THERMAL TRANSFER DYE IMAGE-RECEIVING SHEET

BACKGROUND OF THE INVENTION

1. Field of the Invention

The present invention relates to a thermal transfer dye image-receiving sheet. More particularly, the present invention relates to a sheet for recording thereon thermally transferred dye images in a medium color reproduction, at a high resolution, and with a high tone reproduction.

2. Description of the Related Arts

Currently there is enormous interest in the development of new types of color printers capable of recording clear images or pictures, for example, relatively compact thermal printing systems, especially sublimating dye-thermal transfer printers.

In the sublimating dye-thermal transfer printing system, colored images or pictures are formed by superposing thermally transferred yellow, magenta and cyan colored images or pictures in the form of a number of dots, to reproduce colored images or pictures having a continuous hue and color density.

In the sublimating dye thermal transfer printing system, an ink sheet composed of a base film and a sublimating dye layer formed on the base film is superposed on a dye image-receiving sheet composed of a support sheet, and a dye image-receiving layer formed on the support sheet in such a manner that the sublimating dye layer of the ink sheet comes into contact with the dye image-receiving layer of the dye image-receiving sheet, and the ink sheet is locally heated by heat supplied from a thermal head of the printer in accordance with electrical signals corresponding to the images or pictures to be printed, whereby portions of the sublimating ink in the ink sheet are thermally transferred to the dye image-receiving layer to provide colored images in a predetermined pattern and having a predetermined color density (darkness).

Also, in a thermal melting ink transfer printing system, it is possible to print continuous tone full color images on an image-receiving sheet by using a special ink sheet and by thermally transferring a portion of ink in the special ink sheet to the image-receiving sheet through stepwise heating by a thermal head.

It is known that the conventional image-receiving sheet or a substrate sheet for the image-receiving sheet is made from a paper sheet comprising, as a principal component, a cellulose pulp or a surface-smoothed paper sheet, but the conventional paper sheet comprising as a principal component, the cellulose pulp is not satisfactory as a thermal transfer image-receiving sheet capable of recording uniform, continuous tone images thereon, even when the conventional paper sheet is surface-smoothed.

Especially, in a thermal transfer printing system in which the amount of an ink melt to be transferred is controlled by the heat supplied from the thermal head and the sublimating dye thermal transfer printing system, the uniformity in the ink or dyereceiving property of the image-receiving layer in the image-receiving sheet greatly influences the reproducibility of the images. Therefore, when the conventional image-receiving sheet is used, sometimes the resultant solid print has an unevenness in the darkness (color density) thereof, and the transfer of dots is not stable, and thus it is difficult to provide satisfactory continuous tone colored images on the sheet.

To eliminate the above-mentioned disadvantages, an attempt was made to provide, as a substrate sheet, a synthetic paper sheet consisting of a biaxially drawn multilayer polyolefin film comprising, as a principal component, a mixture of a polyolefin resin, for example, a polypropylene resin with an inorganic pigment, and to then form an image-receiving layer on the above-mentioned substrate sheet.

In an image-receiving sheet for a sublimating dye thermal transfer printer, usually a dye image-receiving layer comprising, as a principal component, a polyester resin is formed on the above-mentioned substrate sheet. This type of image-receiving sheet is advantageous in that the sheet has a uniform thickness, a satisfactory flexibility and softness, and a smaller thermal conductivity than that of the conventional paper sheet comprising a cellulose pulp, and thus can receive, images having a high uniformity and color density.

Nevertheless, where the biaxially oriented multilayer film comprising, as a principal component, a polypropylene resin, is used as a substrate sheet, the resultant image-receiving sheet is disadvantageous in that, when images are recorded on the sheet by using a thermal head, the remaining stress in the substrate sheet derived from a drawing process applied to the polypropylene resin sheet is released, and thus the image-receiving sheet is locally shrunk to generate curls and wrinkles in the sheet. These curls and wrinkles hinder the smooth conveyance of the image-receiving sheet through the printing system, and the resultant print has a significantly lower commercial value. Particularly, in the sublimating dye thermal transfer printing system in which a large amount of heat is necessary for the dye-transferring operation, the above-mentioned disadvantages become prominent.

To eliminate the above-mentioned disadvantages, for example, unevenness of received images, by not employing the thermoplastic substrate sheet, Japanese Unexamined Patent Publication No. 62-21590 discloses an attempt to provide a barrier layer comprising an organic polymeric material and formed on a substrate paper sheet.

Nevertheless, this type of image-receiving sheet is disadvantageous in that, to provide printed high quality images, the image-receiving surface must have a very high smoothness, and if the surface smoothness is unsatisfactory, an even transfer of the ink or dye is not obtained, and thus the resultant transferred images have an uneven color density.

U.S. Pat. No. 4,774,224 to Eastman Kodak Co. discloses that the surface smoothness or roughness of the barrier layer comprising the organic polymeric material and formed on the substrate paper sheet has a great influence on the uniformity in color density and gloss of the images formed on the image-receiving layer. Particularly, the direct interdependency between the surface smoothness of the organic polymeric material barrier layer and the uniformity of the transferred images is poor, and when the surface smoothness of the barrier layer is too high, the barrier layer surface exhibits a poor adhesion to the image receiving layer. Further, when the image receiving layer is coated on the barrier layer, sometimes undesirable streaks are formed thereon. Also, it was found that the substrate paper sheet, which naturally has a high rigidity, causes a lowering of the close adhesion between the image-receiving layer and the thermal head, and thus the uniformity of the transferred images on the image-receiving sheet is lowered. To prevent the formation of uneven images, the thermal head must be brought into close contact with the image-receiving layer, under an increased contact pressure, and this close contact of the thermal head under a high pressure shortens the durability (operating life) of the thermal head.

As mentioned above, generally, when a paper sheet comprising, as a principal component, a cellulose pulp is used as a substrate sheet, the resultant image-receiving sheet has a relatively low sensitivity for receiving ink or dye images. To eliminate this disadvantage, an attempt was made, as disclosed in Japanese Unexamined Patent Publication No. 1-97690, to provide a shielding layer comprising a polyethylene resin and formed between the substrate paper sheet and the image-receiving layer. Nevertheless, the resultant image-receiving sheet exhibits a lower sensitivity for receiving transferred ink or dye images than that of the above-mentioned image-receiving sheet in which the substrate sheet consists of a monoaxially or biaxially drawn multilayer film comprising, as a principal component, a polypropylene resin. Therefore, there is a strong demand for the provision of an image-receiving sheet having a high sensitivity.

Furthermore, since the image-receiving sheet is used in the form of a cut sheet, a proper rigidity is an important factor when ensuring a smooth conveyance of the cut image-receiving sheet through the printing system. Also, to evenly produce clear and sharp images transferred to the image-receiving sheet in accordance with the amount of thermal energy, a close contact of the thermal head with the image-receiving layer surface is very important.

Accordingly, where a laminate paper sheet comprising a fine paper sheet and a polyethylene coating layer formed on the fine paper sheet is used as a substrate sheet, if the laminate paper sheet has a low rigidity, the resultant image receiving sheet often causes a jam in the system, or is incorrectly supplied as two or three sheets at the same time, or if the rigidity of the laminate paper sheet is too high, the close contact between the thermal head and the image-receiving layer of the resultant image-receiving sheet is not satisfactory, and thus the uniformity of the transferred images is lowered.

Therefore, there is a strong demand for the provision of a new type of image-receiving sheet able to be smoothly conveyed through the thermal transfer printing system and have uniform colored images formed thereon.

SUMMARY OF THE INVENTION

An object of the present invention is to provide a thermal transfer image-receiving sheet capable of recording thereon sublimating dye images or pictures with an excellent clarity, a high resolution, and a high reproducibility. Another object of the present invention is to provide a thermal transfer image-receiving sheet useful for recording sublimating dye images with a uniform quality in a continuous tone color density, without the formation of undesirable curls and wrinkles during a thermal transfer printing operation.

The above-mentioned objects can be obtained by the thermal transfer dye image-receiving sheet of the present invention, which comprises a substrate sheet composed of a support sheet comprising, as a principal component, a cellulose pulp, and a front coated layer formed on the front surface of the support sheet and comprising, as a principal component, a thermoplastic resin; and a dye image-receiving layer formed on a front surface of the front coating layer and comprising, as a principal component, a resinous material capable of being dyed with dyes for forming colored images, said front surface of the front coated layer having a Bekk smoothness of 100 seconds or more, and said substrate sheet having a rigidity of 700 mgf or less determined in the direction along which the dye image-receiving sheet is moved during a thermal transfer operation and in accordance with a test method defined in TAPPI, T543, pm 84.

DESCRIPTION OF THE PREFERRED EMBODIMENTS

Figure 1:
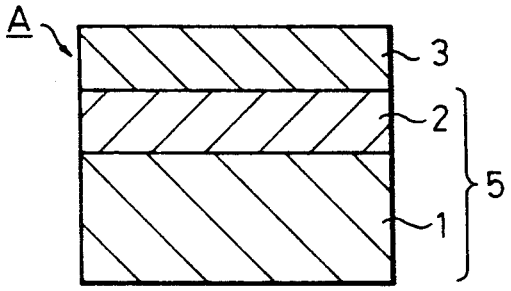
FIG. 1 is an explanatory cross-sectional view of an embodiment of the thermal transfer dye image-receiving sheet of the present invention; and, FIG. 2 is an explanatory cross-sectional view of another embodiment of the thermal transfer dye image-receiving sheet of the present invention.
Figure 2:
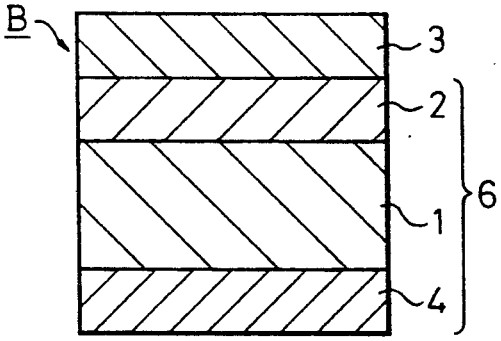

The thermal transfer dye image-receiving sheet of the present invention has a multilayer structure as shown, for example, in FIG. 1 or 2.

Referring to FIG. 1, a thermal transfer dye image-receiving sheet A of the present invention is composed of a substrate sheet 5 comprising a support sheet 1 and a front coated layer 2 formed on a front surface of the support sheet 1, and a dye image-receiving layer 3 formed on a front surface of the front coated layer.

Referring to FIG. 2, another thermal transfer dye image-receiving sheet B of the present invention comprises a substrate sheet 6, composed of a support sheet 1, a front coated layer 2 formed on a front surface of the support sheet 1 and a back coating layer 4 formed on a back surface of the support sheet 1, and a dye image-receiving layer 3 formed on the front coated layer.

The support sheet usable for the present invention is formed by a paper sheet comprising, as a principal component, a cellulose pulp, which has an inherent high heat resistance and a good heat stability.

The paper sheet comprising, as a principal component, a cellulose pulp material can be smoothed at the front and back surface thereof to a predetermined extent by using specific types of pulp materials, utilizing a specific pulp-treating method, adding a specific type of an additive to the pulp material or applying a post-treatment, and the smoothed surface effectively improves the uniformity of the dye images transferred to the dye image-receiving sheet.

The paper sheet usable as a support sheet of the present invention is not limited to a specific type of paper sheet, but is usually a fine paper sheet. Also there is no limitation of the thickness, rigidity and basis weight thereof, and these factors are selected in consideration of the use of the dye image-receiving sheet.

Usually, the support sheet is preferably formed from a fine paper sheet having a basis weight of 40 to 200 $g/m^2$, more preferably 120° to 160 $g/m^2$.

The front coated layer is formed on the front surface of the support sheet and comprises, as a principal component, a thermoplastic resin.

The thermoplastic resin is preferably selected from the group consisting of polyolefin resins, polyacetal resins, polyamide (nylon) resins and polyvinyl chloride resins, more preferably from the polyolefin resins. The polyolefin resins usable for the front coating layer are preferably selected from polyethylene resins, ethylenecopolymer resins, polypropylene resins, polybutene resins, polypentene resins, copolymers of two or more of the above-mentioned olefin monomers and mixtures of two or more of the above-mentioned resins.

There is no specific limitation of the thickness and the weight of the front coated layer, but usually the front coated layer preferably has a thickness of 5 to 50 μm, more preferably 15 to 40 μm, and a weight of 5 to 80 g/m$^2$, more preferably 13 to 65 g/m$^2$.

The dye image-receiving layer is formed on the front surface of the front coated layer, from a thermoplastic resin material able to be dyed with and have fixed therein sublimating dyes. The sublimating dye-dyeable thermoplastic resin material comprises at least one member selected from saturated polyester resins, polycarbonate resins, polyacrylic resins, and polyvinyl acetate resins. These is no specific restriction of the thickness and weight of the dye image-receiving layer, but usually the dye image-receiving layer preferably has a thickness of 2 to 20 μm, more preferably 4 to 17 μm, and a weight of 3 to 30 g/m$^2$, more preferably 5 to 25 g/m$^2$.

The substrate sheet is optionally provided with a back coated layer formed on the back surface of the support sheet and comprising a thermoplastic resin. The thermoplastic resin for the back coated layer may be selected from those used for the front coated layer.

There is no specific restriction of the thickness and the weight of the back coated layer, but usually the back coated layer preferably has a thickness of 5 to 30 μm, more preferably 10 to 30 μm, and a weight of 5 to 30 g/m$^2$, more preferably 10 to 30 g/m$^2$.

The back coated layer formed on the support sheet and comprising a thermoplastic resin effectively prevents the formation of curls in the resultant dye image-receiving sheet and enhances the water-proofing property and the weathering resistance of the dye image-receiving sheet.

Where the back coated layer is provided with a matted surface which can be printed or hand-written with a pencil or pen, the matted surface of the back coated layer can be formed by laminating a layer of, for example, a polyolefin resin on the back surface of the support sheet by a melt-extruding procedure, and coating and pressing the surface of the back coated layer, which is in the thermoplastic state, with a cooling roll having a matted peripheral surface thereof in a predetermined pattern, whereby the matted pattern of the cooling roll is transferred to the surface of the back coated layer.

In the dye image-receiving sheet of the present invention, the thermoplastic resin for the front, and optionally, back coated layers optionally contains a white pigment.

The white pigment usable for the present invention comprises at least one member selected from titanium dioxide, zinc sulfide, zinc oxide, calcium sulfate, calcium sulfite, barium sulfate, clay, sintered clay, talc, kaolin, calcium carbonate, silica and calcium silicate, which are usually used as a white pigment for conventional thermoplastic resins, for example, polyolefin resins.

The thermoplastic resins and the white pigments preferably have a high whiteness and extrude-coating property when subjected to melt lamination, and the resultant coated layer preferably has a high smoothness and can be firmly adhered to the substrate sheet.

By using a suitable white pigment, the surface smoothness of the front coated layer formed by the melt-extrude-laminator can be controlled to a certain extend.

Usually, the content of the white pigment in the front or back coated layer is preferably 20% by weight or less. When the white pigment content is more than 20% by white, the resultant coated layer has a poor mechanical strength and cracks frequently appear therein.

The front coated layer having a high whiteness and a high surface smoothness contributes to the providing of a dye image-receiving layer having a high surface smoothness, which gives thermally transferred dye images having a high accuracy, sensitivity, and harmony. The dye image-receiving layer can be formed on the front coated layer by coating a coating liquid in a conventional manner, for example, using a bar coater, gravure coater, comma coater, blade coater, air knife coater or gut rotter coater, and drying or solidifying the resultant coating liquid layer.

The total thickness, weight and rigidity of the dye image-receiving sheet of the present invention are selected in consideration of uses thereof, for example, color prints, computer graphics, labels, and cards. Usually, the dye image-receiving sheet of the present invention preferably has a total thickness of 60 to 200 82 m.

In the dye image-receiving sheet of the present invention, the surface smoothness of the front coated layer has no direct influence on the quality of the transferred images. Nevertheless, to enhance the surface smoothness and surface activity for receiving the dye images, the front coated layer surface must have a predetermined level or more of smoothness. Where the substrate sheet has an excessively high rigidity or stiffness, even when the dye image-receiving layer surface has a high smoothness, the required close contact of the dye-image-receiving layer surface with a thermal head is sometimes unsatisfactory.

Therefore, not only must the front coated layer surface have a predetermined high level or more of smoothness, but also the substrate sheet must have a predetermined level or less of rigidity.

Accordingly, in the dye image-receiving sheet of the present invention, the substrate sheet preferably has a rigidity of 700 mgf or less measured in the direction along which the dye image-receiving sheet is traveled during the thermal transfer operation, and determined in accordance with the test method of TAPPI, T543, pm 84.

The front surface of the front coated layer preferably has a Beck smoothness of 100 seconds or more, more preferably 100 to 5000 seconds. The Bekk smoothness can be determined in accordance with Japanese Industrial Standard (JIS) P8119.

Generally, it is known that the rigidity of a paper sheet is positively proportional to the modulus of elasticity and to the cube of the thickness of the paper sheet, and inversely proportional to the basis weight of the paper sheet.

The close contact of the thermal head with a surface of an image-receiving sheet can be effectively enhanced by lowering the rigidity of the substrate sheet, and the rigidity can be effectively lowered by reducing the basis weight and the thickness of the support sheet. Also, since the modulus of elasticity of the paper sheet is positively proportional to the square of the density of the paper sheet, preferably the density of the support sheet is reduced, to thereby enhance the close contact of the thermal head with the image-receiving sheet surface.

In the dye image-receiving sheet of the present invention, the rigidity of the substrate sheet is limited to 700 mgf or less because, if the rigidity is more than 700 mgf, the close contact of the thermal head with the dye image-receiving sheet becomes unsatisfactory and the quality, especially, uniformity of the color depth, of the transferred-images is lowered. Even if the Bekk surface smoothness of the front coated layer is 100 seconds or more, if the rigidity of the substrate sheet is more than 700 mgf, it is difficult to obtain transferred dye images having a satisfactorily uniform color density or shade. Also, the front surface of the support sheet preferably has a Bekk smoothness of 100 seconds or more.

The front coated layer of the dye image-receiving sheet of the present invention must have a Bekk surface smoothness of 100 seconds or more, preferably 200 to 5000 seconds. If the surface smoothness of the front coated layer is less than 100 seconds, that surface exhibits an unsatisfactory coatability with regard to a dye image-receiving layer coating liquid, and the quality of the transferred dye images on the dye image-receiving layer becomes unsatisfactory. When the Bekk smoothness is more than 5000 seconds, the resultant surface of the front coated layer may cause an unsatisfactory bonding between the front coated layer and the dye image-receiving layer.

The dye image-receiving layer formed on the front coating layer preferably has a Bekk surface smoothness of 1000 seconds or more, more preferably 5000 seconds or more. When the Bekk surface smoothness of the dye image-receiving layer is less than 1000 seconds, the transferred dye images on the resultant dye image-receiving layer sometimes have an unsatisfactory quality, especially the uniformity of the color density.

When a back coated layer is provided on a back surface of the support sheet, preferably the back surface of the substrate sheet has a Bekk smoothness of 100 seconds or more and the back coated layer has a Bekk surface smoothness of 1000 seconds or more. The above-mentioned specific smoothness of the back surface of the substrate sheet and the back coated layer surface effectively enhance the quality of the transferred dye images.

In an embodiment of the dye image-receiving sheet of the present invention, the front and back surfaces of the support sheet preferably have a surface roughness (Ra value) of 0.5 μm or more, determined in accordance with JIS B0601, the front coated layer surface preferably has a surface roughness (Ra value) of 0.5 to 2.0 μm, and the dye image-receiving layer surface preferably has a surface roughness (Ra value) of 0.1 to 2.0 μm, preferably 0.5 to 2.0 um. This surface roughness (Ra value) can be determined in accordance with JIS B0601.

The term surface roughness refers to a centerline average roughness (Ra) as defined by the following equation:

$$Ra = \frac{1}{l}\int_0^l |f(x)|\,dx$$

wherein l represents a length of a specimen and $y=f(x)$ represents a roughness curve.

When a back coated layer is provided on the back surface of the support sheet, the surface roughness (Ra value) of the back coated layer surface is preferably 0.5 to 20 μm.

The support sheet surfaces having a surface roughness (Ra value) of 0.5 μm or more provide a firm bonding with the front and back coated layers.

The front coated layer surface having a surface roughness (Ra value) of 0.5 to 2.0 μm contributes to a firm fixing and forming of the dye image-receiving layer having a satisfactory smoothness.

The dye image-receiving layer surface having a surface roughness (Ra value) of 0.1 to 2.0 μm surface prevents the heat adhesion of the dye imagereceiving layer with a dye sheet during the thermal transfer operation, and enhances the quality of the dye images transferred thereto.

In an embodiment of the dye image-receiving sheet of the present invention, preferably the front coated layer and the dye image-receiving layer satisfy the relationships (1) and (2):

$$k_2/k_2 \geqq 1 (1), \text{ preferably } k_1/k_2 \geqq 2,$$

and $$t_2/t_1 \geqq 1 (2), \text{ preferably } t_2/t_1 \geqq 2$$

wherein $k_1$ represents the thermal conductivity of the front coated layer, $k_2$ represents the thermal conductivity of the dye image-receiving layer, $t_1$ represents the thickness of the front coated layer, and $t_2$ represents the thickness of the dye image-receiving layer.

When the relationships (1) and (2) are satisfied, the dye image-receiving sheet exhibits a satisfactory heat insulating property such that, during the thermal transfer printing operation, an undesirable diffusion of a heat energy applied to the dye image-receiving layer into the support sheet, through the front coated layer, is prevented and the temperatures of the dye sheet and the dye image-receiving layer are elevated to a level necessary for a thermal transfer of the sublimating dye.

When $k_1/k_2<1$ and/or $t_2/t_1>1$, the resultant dye image-receiving sheet exhibits an unsatisfactory sensitivity for receiving the thermally transferred dye.

Usually, the dye image receiving layer preferably has a thermal conductivity of $4\times10^{-5}$ to $5\times10^{-4}$ cal/sec.cm.° C. and a thickness of 2 to 15 μm. Also, the front coated layer preferably has a thermal conductivity of $4\times10^{-5}$ to $2\times10^{-4}$ cal/sec.cm.° C. and a thickness of 15 to 40 μm.

The front coated layer is optionally provided with a number of fine pores, which effectively lower the thermal conductivity thereof. The fine pores can be formed by adding a blowing agent to a matrix comprising a mixture of a thermoplastic resin and an inorganic pigment. The blowing agent preferably comprises at least one member selected from organic blowing compounds, for example, azo compounds, nitroso compounds and sulfornium hydrazide compounds, and inorganic blowing compounds, for example, sodium hydrogen carbonate and ammonium hydrogen carbonate.

In an embodiment of the dye image-receiving sheet of the present invention, the support sheet has a basis weight of 120 to 160 g/m$^2$ and a thickness of 120 to 160 μm, the front coated layer has a thickness of 15 to 40 μm, the image-receiving layer has a thickness of 2 to 15 μm, and optionally, the back coated layer has a thickness of 10 to 30 μm.

When the component layers have the above-mentioned thicknesses and basis weights, the resultant dye image-receiving sheet exhibits a suitable flexibility and rigidity (softness), and thus the thermal head can be brought into close contact with the dye image-receiving sheet, dye images having a highly uniform color density can be transferred with a high accuracy and reproducibility and the resultant dye image receiving sheet can be smoothly traveled through the printing machine. Also, the above-mentioned specific thicknesses effectively provide a firm bonding of the component layers to each other.

Furthermore, the back coated layer having a thickness of 10 to 30 μm effectively prevents the undesirable generation of curls and wrinkles in the resultant image-receiving sheet during the thermal transfer printing operation.

The dye image-receiving sheet of the present invention can receive thermally transferred images or pictures with a high clarity, a high tone reproduction, an excellent uniformity of not only shadow portions but also highlight portions, and provide a superior resistance to curling during the printing procedure.

EXAMPLES

The present invention will be further explained by the following examples.

In the examples, the dye image-receiving property of the image-receiving sheets was tested and evaluated in the following manner.

Yellow, magenta and cyan dye-containing ink sheets each consisting of a substrate consisting of a polyester film with a thickness of 6 μm and a sublimating dye-containing ink-coating layer formed on a surface of the substrate were used in the sublimating dye thermal transfer printer, a thermal head of the printer was heated stepwise in predetermined amount of heat, and the thermal transferred dye images were formed in a single color or a mixed (superposed) color provided by superposing yellow, magenta and cyan colored dye images.

The clarity (sharpness) of the images, the uniformity of shape of the dots, the evenness of shading of close-printed portions, and the resistance of the sheet to thermal curling were observed by the naked eye and evaluated in five classes as follows.

| Class | Evaluation |
|---|---|
| 5 | Excellent |
| 4 | Good |
| 3 | Satisfactory |
| 2 | Not satisfactory |
| 1 | Bad |

The resistance of the transferred images on the image-receiving sheet to blistering was determined in the following manner.

A specimen was heated in a hot air dryer at a temperature of 120° C. for 3 minutes, and blistering of the images on the specimen was observed by the naked eye and evaluated in five classes as mentioned above.

Also, the adhesion strength of the image-receiving layer to the front coated layer was determined in the following manner.

An adhesive tape was adhered to the surface of the image-receiving layer of a specimen and then peeled out therefrom. The tested surface of the specimen was observed by the naked eye to evaluate the adhesion strength of the image-receiving layer to the front layer of the specimen.

EXAMPLE 1

A fine paper sheet having a basis weight of 150 g/m$^2$ and a thickness of 148 μm was employed as a support sheet, and a front (felt side) surface of the support sheet was coated with a front coated layer comprising a polyethylene resin mixed with 10% by weight of a titanium dioxide white pigment and having a weight of 35 g/m$^2$, by a melt-extrusion laminating process. Also, the back (wire side) surface of the support sheet was coated with a back coated layer comprising a polyethylene resin and having a weight of 30 g/m$^2$, by a melt-extrusion laminating process.

The front coated layer surface was subjected to a corona discharge treatment. The resultant front coated layer surface had a Bekk smoothness of 140,000 seconds or more, and the resultant substrate sheet had a rigidity of 660 mgf.

A coating liquid having the following composition was prepared for the dye image-receiving layer:

| Composition of coating liquid 1<br>Component | Part by weight |
|---|---|
| Saturated polyester resin (*)$_1$ | 100 |
| Silicone resin (*)$_2$ | 5 |
| Toluene | 500 |
| Methylethylketone | 100 |

Note:
(*)$_1$Available under the trademark of Baylon 200, from Toyobo Co.
(*)$_2$Available under the trademark of Silicone SH-3746, from Toray Silicone Co.

The coating liquid was coated on the front coated layer by a doctor blade coating method, and dried so that the resultant dried dye image-receiving layer had a weight of 10 g/cm$^2$, and thus a dye image-receiving sheet was obtained.

The results of the above-mentioned tests are shown in Table 1.

EXAMPLE 2

The same procedures as those of Example 1 were carried out, except that the front coated layer had a weight of 20 g/m$^2$ and a back coated layer comprising a polyethylene resin and having a weight of 18 g/m$^2$ was formed on a back surface of the support sheet by a melt-extrusion laminating method. The resultant front coated layer had a Bekk surface smoothness of 70,000 seconds, and the resultant substrate sheet had a rigidity of 610 mgf.

The test results are shown in Table 1.

EXAMPLE 3

The same procedures as of Example 1 were carried out, except that the support sheet was composed of a coated paper sheet having a basis weight of 64 g/m$^2$ and a thickness of 57 μm, the front coated layer had a weight of 30 g/m$^2$, a back coated layer comprising a polyethylene resin was formed in an dry weight of 28 g/m$^2$ on a back surface of the support sheet, and the dye image-receiving layer was provided by a die coating method.

The resultant front coated layer had a Bekk surface smoothness of 140,000 seconds or more, and the resultant substrate sheet had a rigidity of 90 mgf.

The best results are shown in Table 1.

EXAMPLE 4

The same procedures as of Example 1 were carried out except that, in the melt-extrusion laminating process for the front coated layer, the front coated layer surface was brought into contact with an embossing cooling roll to adjust the Bekk surface smoothness of the resultant front coated layer to 3000 seconds, and the resultant substrate sheet had a rigidity of 660 mgf.

The test results are shown in Table 1.

COMPARATIVE EXAMPLE 1

The same procedures as of Example 1 were carried out, except that the support sheet was composed of a fine paper sheet having a basis weight of 180 g/m$^2$ and a thickness of 237 μm.

The resultant substrate sheet had a large rigidity of 1550 mgf, whereas the front coated layer exhibited a Bekk surface smoothness of 140,000 seconds or more.

The test results are indicated in Table 1.

COMPARATIVE EXAMPLE 2

The same procedures as of Example 1 were carried out, except that the same fine paper sheet as mentioned in Comparative Example 1 was employed as a support sheet, the front coated layer was in a dry weight of 8 g/m$^2$, and the back coated layer was in a dry weight of 7 g/m$^2$ The resultant front coated layer exhibited a poor Bekk surface smoothness of 76 seconds, and the resultant substrate sheet had a large rigidity of 1,550 mgf.

The test results are shown in Table 1.

COMPARATIVE EXAMPLE 3

The same procedures as in Example 1 were carried out, except that the front and back coated layers were formed in the same manner as in Example 3.

The resultant front coated layer surface had a poor Bekk smoothness of 30 seconds, whereas the resultant substrate sheet had a satisfactory rigidity of 550 mgf.

TABLE 1

| Example No. | Item | Bekk smoothness (sec) of front coated layer surface | Rigidity (mgf) of substrate sheet | Uniformity of dye image | Clarity of image |
|---|---|---|---|---|---|
| Example | 1 | ≧140,000 | 660 | 5 | 5 |
| | 2 | 70,000 | 610 | 5 | 5 |
| | 3 | ≧140,000 | 90 | 5 | 4 |
| | 4 | 3,000 | 660 | 4 | 5 |
| Comparative Example | 1 | ≧140,000 | 1550 | 2 | 3 |
| | 2 | 76 | 1550 | 1 | 2 |
| | 3 | 30 | 550 | 2 | 3 |

EXAMPLE 5

A fine paper sheet having a basis weight of 170 g/m$^2$, a front surface Beck smoothness of 197 seconds, and a back surface Bekk smoothness of 200 seconds, was employed as a support sheet.

A front coated layer comprising a polyethylene resin blended with 10% by weight of titanium dioxide was formed in a weight of 30 g/m$^2$ on the front surface of the support sheet by a melt-extrusion laminating process.

The front coated layer surface was activated by a corona discharge treatment, and the resultant front coated surface had a Bekk smoothness of 3500 seconds.

The same coating liquid for a dye image-receiving layer as in Example 1 was coated in a dry weight of 10 g/m$^2$ on the front coated layer surface by a doctor blade coating method and dried. The resultant dye image-receiving layer had a Bekk surface smoothness of seconds.

The resultant substrate sheet had a rigidity of 610 mgf.

The same tests as in Example 1 were applied to the resultant dye image-receiving sheet, and the test results are shown in Table 2.

EXAMPLE 6

The same procedures as of Example 5 were carried out, except that the back coated layer was formed in an amount of 25 g/m$^2$ and had a Bekk surface smoothness of 15,000 seconds, The test results are shown in Table 2.

EXAMPLE 7

The same procedures as of Example 6 were carried out, except that the image-receiving layer was formed by a dye coating method. The resultant image-receiving layer surface had a Bekk smoothness of 20,000 seconds.

The test results are shown in Table 2.

EXAMPLE 8

The same procedures as of Example 5 were carried out, except that the front surface of the same fine paper sheet as in Example 5 was smoothed by a super calender, the resultant support sheet surface had a Bekk smoothness of 350 seconds, and the front and back coated layers was formed on the support sheet in the same manner as in Example 6.

The front coated layer surface had a Bekk smoothness of 3,500 seconds.

The dye image-receiving layer surface had a Bekk smoothness of 8000 seconds.

The back coated layer surface had a Bekk smoothness of 800 seconds.

The test results are shown in Table 2.

EXAMPLE 9

The same procedures as of Example 5 were carried the following exception.

The support sheet was composed of a fine paper sheet having a basis weight of 170 g/m$^2$ and provided with a very good ground texture. The support sheet had a front surface Bekk smoothness of 300 seconds and a back surface Bekk smoothness of 280 seconds.

The front and second coated layers were formed on the support sheet in the same manner as in Example 6. The front and back coated layer surfaces had a Bekk smoothness of 5000 seconds.

The dye image-receiving layer in an amount of 10 g/m$^2$ had a Bekk smoothness of 25000 seconds.

The test results are indicated in Table 2.

COMPARATIVE EXAMPLE 4

The same procedures as of Example 5 were carried out, except that the front coated layer was formed on the same support sheet as in Example 5 by a polyethylene laminate method and had a Bekk smoothness of 9000 seconds, and the back coated layer was formed in the same manner as in Example 6 and had a Bekk smoothness of 5000 seconds. Also, the dye image-receiving layer having a dry weight of 10 g/m$^2$ was formed by a mayer bar coating method and had a Bekk smoothness of 8900 seconds.

The test results are indicated in Table 2.

COMPARATIVE EXAMPLE 5

The same procedure as of Example 5 were carried out, except that the same front and back coated layers as in Example 6 were formed on the same support sheet as in Example 8, the front coated layer consisted of a low viscosity polyethylene resin and had a Bekk smoothness of 24000 seconds, the dye image-receiving layer having a weight of 10 g/m$^2$ was formed by a doctor blade coating method and had a Bekk smoothness of 8500 seconds, and the back coated layer had a Bekk smoothness of 4000 seconds.

In the formation of the dye image-receiving layer, significant streaks were formed on the layer.

The test results are indicated in Table 2.

COMPARATIVE EXAMPLE 6

The same procedures as of Example 5 were carried out, with the following exception.

A conventional fine paper sheet for general printing, having a basis weight of 150 g/m$^2$, a front surface Bekk smoothness of 57 seconds, and a back surface Bekk smoothness of 78 seconds, was employed as a support sheet.

The same front and back coated layers as in Example 6 were formed on the above-mentioned support sheet. The front and back coated layers had Bekk smoothness of 2000 seconds and 850 seconds, respectively.

The dye image-receiving layer having a weight of 10 g/m$^2$ was produced by a doctor blade coating method, and had a Bekk smoothness of 5000 seconds.

The test results are shown in Table 2.

TABLE 2

| Example No. | Item | Rigidity of substrate sheet (mgf) | Bekk smoothness (sec): Front surface of support sheet | Front coated layer | Dye image-receiving layer | Back coated layer | Transferred dye image: Adhesion strength | Resistance to bulging | Quality of image |
|---|---|---|---|---|---|---|---|---|---|
| Example | 5 | 610 | 197 | 3500 | 8900 | — | 4 | 4 | 3 |
| | 6 | 690 | 197 | 3500 | 8900 | 15000 | 4 | 4 | 4 |
| | 7 | 690 | 197 | 3500 | 20000 | 15000 | 5 | 5 | 5 |
| | 8 | 670 | 350 | 3500 | 8000 | 800 | 3 | 4 | 4 |
| | 9 | 680 | 300 | 5000 | 25000 | 5000 | 5 | 5 | 5 |
| Comparative Example | 4 | 690 | 197 | 9000 | 8900 | 5000 | 1 | 1 | 3 |
| | 5 | 690 | 350 | 24000 | 8500 | 4000 | 2 | 5 | 5 |
| | 6 | 630 | 57 | 2000 | 5000 | 850 | 4 | 5 | 2 |

EXAMPLE 10

The same procedures as of Example 1 were carried out, with the following exceptions.

The support sheet was composed of a fine paper sheet having a basis weight of 170 g/m$^2$, a front surface roughness (Ra value) of 1.8 μm and a back surface roughness (Ra value) of 2.5 μm. coated layer having a weight of 30 g/m$^2$ was formed from a polyethylene resin blended with 10% by titanium dioxide by a melt-extrusion laminating method, and activated by a corona discharge treatment. The front coated layer had a surface roughness (Ra value) of 1.0 μm, and a Bekk smoothness of 300 seconds.

The back coated layer was not provided. The dye image-receiving layer having a weight of 10 g/m$^2$ was formed by a doctor blade coating method and had a surface roughness (Ra value) of 0.38 μm.

The resultant substrate sheet had a rigidity of 610 mgf.

The test results are shown in Table 3.

EXAMPLE 11

The same procedures as of Example 10 were carried out, with the following exceptions.

A back coated layer having a weight of 25 g/m$^2$ was formed on the back surface of the support sheet by a melt-extrusion laminating method and had a surface roughness (Ra value) of 1.5 μm.

The resultant substrate sheet had a rigidity of 690 mgf.

The test results are indicated in Table 3.

EXAMPLE 12

The same procedures as of Example 11 were carried out, except that the dye image-receiving layer was formed by a die coating method and had a surface roughness (Ra value) of 0.50 μm.

The test results are shown in Table 3.

EXAMPLE 13

The same procedures as of Example 11 were carried out, with the following exceptions.

A support sheet having a front surface roughness (Ra value) of 1.1 μm was prepared by treating the front surface of a fine paper sheet having a basis weight of 170 g/m$^2$ by a super calender.

The front and back coated layers formed on the above-mentioned support sheet had surface roughnesses of 0.5 μm and 1.0 μm. The resultant substrate sheet had a rigidity of 670 mgf, and the front coated layer had a Bekk surface smoothness of 2300 seconds.

The image-receiving layer had a surface roughness (Ra value) of 0.25 μm.

The test results are shown in Table 3.

EXAMPLE 14

The same procedures as of Example 11 were carried out, with the following exceptions.

The support sheet was composed of a fine paper sheet having a basis weight of 170 g/m$^2$, a front surface roughness (Ra value) of 1.1 μm, and a back surface roughness (Ra value) of 1.5 μm and exhibiting a good texture.

The front coated layer had a surface roughness (Ra value) of 0.5 μm and a Bekk surface smoothness of 2300 seconds and the back coated layer had a surface roughness (Ra value) of 1.0 μm.

The resultant substrate sheet had a rigidity of 690 mgf.

The dye image-receiving layer had a surface roughness (Ra value) of 0.45 μm.

The test results are shown in Table 3.

COMPARATIVE EXAMPLE 7

The same procedures as of Example 11 were carried out, with the following exceptions.

The front coated layer was formed from a polyethylene resin by a melt extrusion laminating method and had a Bekk surface smoothness of 10 seconds and a surface roughness (Ra value) of 4.0 μm.

The back coated layer had a surface roughness (Ra value) of 6.0 μm.

The substrate sheet had a rigidity of 690 mgf.

The dye image-receiving layer had a surface roughness (Ra value) of 3.5 μm.

The test results are shown in Table 3.

COMPARATIVE EXAMPLE 8

The same procedures as of Example 11 were carried out, with the following exception.

The support sheet was composed of the same surface smoothed fine paper sheet as mentioned in Example 13.

The front coated layer was formed from a low density polyethylene resin by a special laminating method by which the resultant coated layer surface had a high smoothness, and had a Bekk smoothness of 50,000 seconds and a surface roughness (Ra value) of 0.20 μm.

The resultant substrate sheet had a rigidity of 670 mgf.

The dye image-receiving layer had a surface roughness (Ra value) of 0.23 μm.

The test results are shown in Table 3.

COMPARATIVE EXAMPLE 9

The same procedures as of Example 11 were carried out, with the following exceptions.

The support sheet was composed of a conventional printing fine paper sheet having a basis weight of 150 g/m$^2$, a front surface roughness (Ra value) of 15.0 μm, and a back surface roughness (Ra value) of 18.0 μm.

The front coated layer had a Bekk surface smoothness of 5 seconds and a surface roughness (Ra value) of 8.0 μm, and the back coated layer had a surface roughness (Ra value) of 10.0 μm.

The resultant substrate sheet had a rigidity of 630 mgf.

The dye image-receiving layer had a surface roughness (Ra value) of 5.0 μm.

The test results are indicated in Table 3.

TABLE 3

| Example No. | Item | Rigidity of substrate sheet (mgf) | Surface roughness (μm): Front surface of support sheet | Front coated layer | Back coated layer | Image-receiving layer | Bekk smoothness of front coating layer (sec) | Transferred image: Adhesion strength | Resistance to bulging | Clarity |
|---|---|---|---|---|---|---|---|---|---|---|
| Example | 10 | 610 | 1.8 | 1.0 | — | 0.38 | 300 | 4 | 4 | 3 |
| | 11 | 690 | 1.8 | 1.0 | 1.5 | 0.38 | 300 | 4 | 4 | 4 |
| | 12 | 690 | 1.8 | 1.0 | 1.5 | 0.50 | 300 | 5 | 5 | 5 |
| | 13 | 670 | 1.1 | 0.50 | 1.0 | 0.25 | 2300 | 3 | 4 | 4 |
| | 14 | 690 | 1.1 | 0.50 | 1.0 | 0.45 | 2300 | 5 | 5 | 5 |
| Comparative Example | 7 | 690 | 1.8 | 4.0 | 6.0 | 3.5 | 10 | 5 | 2 | 2 |
| | 8 | 670 | 1.1 | 0.20 | 1.0 | 0.23 | 50000 | 1 | 5 | 5 |
| | 9 | 630 | 15.0 | 8.0 | 10.0 | 5.0 | 5 | 5 | 1 | 1 |

EXAMPLE 15

The same procedures as described in Example 1 were carried out, with the following exceptions.

A fine paper sheet having a basis weight of 150 g/m$^2$ and a thickness of 148 μm was used as the support sheet.

The front coated layer was formed from a polypropylene resin blended with 10% by weight of titanium dioxide by a melt-extrusion laminating method, and had a weight of 35 g/m, a thickness of 39 μm, a Bekk surface smoothness of 3000 seconds, and a thermal conductivity of $2\times10^{-4}$ cal/sec.cm.° C.

The back coated layer was formed from a polypropylene resin by a melt-extrusion laminating method and a weight of 30 g/m$^2$ and a thickness of 33 μm.

The resultant substrate sheet had a rigidity of 660 mgf.

The dye image-receiving layer had a weight of 10 g/m$^2$, a thickness of 9 μm and a thermal conductivity of $5\times10^{-4}$ cal/sec.cm.° C.

The test results are shown in Table 4.

EXAMPLE 16

The same procedures as described in Example 15 were carried out, with the following exceptions.

The front coated layer had a weight of 20 g/m$^2$, a thickness of 22 μm, a Bekk surface smoothness of 3000 seconds, and a thermal conductivity of $2\times 10^{-4}$ cal/sec.cm.° C.

The back coated layer was formed from a polyethylene resin and had a weight of 18 g/m$^2$ and a thickness of 20 μm.

The resultant substrate sheet had a rigidity of 660 mgf.

The test results are indicated in Table 4.

EXAMPLE 17

The same procedures as of Example 15 were carried out, with the following exceptions.

The front coated layer was formed from a polybutene resin by a melt-extrusion laminating method and had a weight of 35 g/m$^2$, a thickness of 38 μm, a Bekk surface smoothness of 2700 seconds, and a thermal conductivity of about $3.5\times10^{-4}$ cal/sec.cm.° C.

The back coated layer was formed from a polyethylene resin by a melt-extrusion laminating method and had a weight of 30 g/m$^2$.

The resultant substrate sheet had a rigidity of 660 mgf.

The test results are indicated in Table 4.

EXAMPLE 18

The same procedures as of Example 15 were carried out, with the following exceptions.

The support sheet was composed of a coated paper sheet having a basis weight of 64 g/m$^2$ and a thickness of 57 μm.

The front coated layer was formed from a polyvinylidene chloride resin film by a dry laminating method and had a weight of 34 g/m$^2$, a thickness of 20 μm, a Bekk surface smoothness of 2500 seconds, and a thermal conductivity of $3\times10^{-4}$ cal/sec.cm.° C. The back coated layer was the same as the front coated layer.

The resultant substrate sheet had a rigidity of 640 mgf.

The image-receiving layer was formed by a die coating method, and had a thickness of 9 μm and a thermal conductivity of $5\times10^{-4}$ cal/sec.cm.° C.

The test results are shown in Table 4.

EXAMPLE 19

The same procedures as described in Example 15 were carried out, with the following exceptions.

The support sheet was the same as that in Example 18.

The front coated layer was formed from a polystyrene resin film by a dry laminating method, and had a weight of 32 g/m$^2$, a thickness of 30 μm, a Bekk surface smoothness of 4500 seconds, and a thermal conductivity of $1.9\times10^{-4}$ cal/sec.cm.° C.

The back coated layer was the same as the front coated layer.

The resultant substrate sheet had a rigidity of 90 mgf.

The test results are indicated in Table 4.

COMPARATIVE EXAMPLE 10

The same procedures as described in Example 15 were carried out, with the following exceptions.

The support sheet was composed of a fine paper sheet having a basis weight of 180 g/m$^2$ and a thickness of 237 μm.

The front coated layer was formed from a polyethylene resin blended with 10% by weight of titanium dioxide by a melt-extrusion laminating method, and had a weight of 35 g/m$^2$, a thickness of 38 μm, a Bekk surface smoothness of 3000 seconds, and a thermal conductivity of about $11\times10^{-4}$ cal/sec.cm.° C.

The back coated layer was formed from a polyethylene resin by a melt-extrusion laminating method and had a weight of 30 g/m$^2$ and a thickness of 32 μm.

The surface of the front coating layer was activated by a corona discharge treatment.

The resultant substrate sheet had a rigidity of 1550 mgf.

The image-receiving layer was formed by a mayer bar coating method, and had the same thickness and thermal conductivity as in Example 15.

The test results are shown in Table 4.

COMPARATIVE EXAMPLE 11

The same procedures as of Example 15 were carried out, with the following exceptions.

The support sheet was the same as that in Comparative Example 10.

The front coated layer had a thickness of 4 μm and was surface-activated by the corona discharge treatment.

The back coated layer had a thickness of 4 μm.

The resultant substrate sheet had a rigidity of 1550 mgf.

The image-receiving layer was formed by the same method as in Comparative Example 10.

The test results are indicated in Table 4.

COMPARATIVE EXAMPLE 12

The same procedures as of Example 15 were carried out, with the following exceptions.

The support sheet was the same as in Example 19.

The front coated layer was formed from a polyamide film by a dry laminating method, and had a weight of 26 g/m$^2$, a thickness of 25 μm, a Bekk surface smoothness of 2000 seconds, and a thermal conductivity of about $6\times10^{-4}$ cal/sec.cm.° C.

The back coated layer was the same as the front coated layer.

The resultant substrate sheet had a rigidity of 640 mgf.

The image-receiving layer was formed by a die coating method and had the same thickness and thermal conductivity as in Example 15.

The test results are shown in Table 4.

TABLE 4

| | | Front coated layer | | | Image-receiving layer | | | | | Transferred image | |
|---|---|---|---|---|---|---|---|---|---|---|---|
| Example No. | Item | Bekk smoothness (sec) | Thickness ($t_1$) (μm) | Thermal conductivity ($k_1$) ($\times10^{-4}$ cal/sec; cm; °C.) | Thickness ($t_2$) (μm) | Thermal conductivity ($k_2$) ($\times10^{-4}$ cal/sec; cm; °C.) | $k_2/k_1$ | $t_2/t_1$ | Rigidity of substrate sheet (mgf) | Sensitivity | Uniformity in shade |
| Example | 15 | 3000 | 39 | 2 | 9 | 5 | 2.5 | 0.23 | 660 | 5 | 5 |
| | 16 | 3000 | 22 | 2 | 9 | 5 | 2.5 | 0.41 | 640 | 5 | 4 |
| | 17 | 2700 | 38 | 3.5 | 9 | 5 | 1.4 | 0.24 | 660 | 3 | 5 |
| | 18 | 4000 | 20 | 3 | 9 | 5 | 1.7 | 0.45 | 90 | 4 | 4 |
| | 19 | 4500 | 30 | 1.9 | 9 | 5 | 2.6 | 0.30 | 90 | 5 | 5 |
| Comparative Example | 10 | 3000 | 38 | 11.0 | 9 | 5 | 0.45 | 0.24 | 1550 | 1 | 2 |
| | 11 | 10 | 4 | 2 | 9 | 5 | 2.5 | 2.3 | 1550 | 2 | 1 |
| | 12 | 2000 | 25 | 6 | 9 | 5 | 0.83 | 0.36 | 640 | 2 | 3 |

EXAMPLE 20

The same procedures as of Example 1 were carried out, with the following exceptions.

The support sheet was composed of a fine paper sheet having a basis weight of 150 g/m$^2$, a thickness of 140 μm, and a front surface Bekk smoothness of 430 seconds.

The front coated layer was formed from a polyethylene resin blended with 10% by weight of titanium dioxide by a melt-extrusion laminating method, surface activated by a corona discharge treatment, and had a thickness of 35 μm and a Bekk surface smoothness of 3000 seconds.

The back coated layer was formed from a polyethylene resin by a melt-extrusion laminating method and had a thickness of 25 82 m.

The resultant substrate sheet had a rigidity of 660 mgf.

The image-receiving layer had a thickness of 8 μm. The test results are shown in Table 5.

EXAMPLE 21

The same procedures as of Example 20 were carried out, except that the front coated layer had a thickness of 25 μm and a Bekk surface smoothness of 2800 seconds, the back coated layer had a thickness of 18 μm, and the resultant substrate sheet had a rigidity of 650 mgf.

The test results are indicated in Table 5.

EXAMPLE 22

The same procedures as of Example 20 were carried out, except that the front coated layer had a thickness of 20 82 m and a Bekk surface smoothness of 2800 seconds, the back coated layer had a thickness of 15 μm, and the resultant substrate sheet had a rigidity of 630 mgf.

The test results are shown in Table 5.

COMPARATIVE EXAMPLE 13

The same procedures of Example 20 were carried out, except that the support sheet was composed of a fine paper sheet having a basis weight of 189 g/m$^2$, a thickness of 180 μm, and a front surface Bekk smoothness of 210 seconds, and the resultant substrate sheet had a rigidity of 1100 mgf.

The test results are shown in Table 5.

COMPARATIVE EXAMPLE 14

The same procedures as of Example 20 were carried out, except that the front coated layer had a thickness of 50 μm and a Bekk surface smoothness of 60000 seconds, the back coated layer had a thickness of 40 μm, and the resultant substrate sheet had a rigidity of 800 mgf.

The test results are shown in Table 5.

COMPARATIVE EXAMPLE 15

The same procedures as of Example 20 were carried out, except that the front coated layer had a thickness of 10 μm and a Bekk surface smoothness of 80 seconds, the back coated layer had a thickness of 10 μm, and the resultant substrate sheet had a rigidity of 600 mgf.

The test results are indicated in Table 5.

COMPARATIVE EXAMPLE 16

The same procedures of Example 20 were carried out, except that the support sheet was composed of a polyolefin synthetic paper sheet which had a thickness of 150 μm and was available under a trademark of Yupo FPG 150, from OJI YUKA GOSEISHI K.K., and the resultant substrate sheet had a rigidity of 340 mgf.

The test results are shown in Table 5.

TABLE 5

| Example No. | Item | Bekk smoothness of front coated layer (sec) | Rigidity of substrate sheet (mgf) | Transferred images | | |
|---|---|---|---|---|---|---|
| | | | | Clarity | Deflection | Resistance to curling |
| Example | 20 | 3000 | 660 | 5 | None | 5 |
| | 21 | 2800 | 650 | 4 | None | 5 |
| | 22 | 2800 | 630 | 4 | None | 5 |
| Compar- | 13 | 1500 | 1100 | 4 | Slightly | 3 |
| ative | 14 | 60000 | 800 | 4 | Remarkable | 5 |
| Example | 15 | 80 | 600 | 3 | Very remarkable | 5 |
| | 16 | — | 340 | 5 | None | 1 |

We claim:

1. A thermal transfer dye image-receiving sheet comprising:

a substrate sheet comprising a support sheet comprising, as a principal component, a cellulose pulp and a front coated layer formed on the front surface of the support sheet and comprising, as a principal component, a thermoplastic resin; and a dye image-receiving layer formed on a front surface of the front coated layer and comprising, as a principal component, a resinous material capable of being dyed with dyes for forming colored images, said front surface of the front coated layer having a Bekk smoothness of 100 to 5000 seconds, and a surface roughness (Ra value) of 0.5 to 2.0 μm, determined in accordance with JIS B 0601, said substrate sheet having a rigidity of 700 mgf or less determined in the direction along which the dye image-receiving sheet is moved during a thermal transfer operation and in accordance with a test method defined in TAPPI, T543pm 84, and said front coated layer and said dye image-receiving layer satisfying the relationships (1) and (2):

$$k_2/_1 \geqq 1 \quad (1)$$

and $$t_2/t_1 \leqq 1 \quad (2)$$

wherein $k_1$ represents the thermal conductivity of the front coated layer, $k_2$ represents the thermal conductivity of the dye imagereceiving layer, $t_1$ represents the thickness of the front coated layer and $t_2$ represents the thickness of the dye image-receiving layer.

2. The dye image-receiving sheet as claimed in claim 1, wherein the front surface of the support sheet has a Bekk smoothness of 100 seconds or more.

3. The dye image-receiving sheet as claimed in claim 1, wherein the dye image-receiving layer has a Bekk surface smoothness of 1000 seconds or more.

4. The dye image-receiving sheet as claimed in claim 1, wherein the support sheet has a surface roughness (Ra value) of 0.5 μm or more, determined in accordance with JIS B0601.

5. The dye image-receiving sheet as claimed in claim 1, wherein the dye image-receiving layer has a surface roughness (Ra value) of from 0.1 to 2.0 μm, determined in accordance with JIS B0601.

6. The dye image-receiving sheet as claimed in claim 1, wherein the substrate sheet has a back coated layer comprising, a a principal component, a thermoplastic resin and formed on a back surface of the support sheet.

7. The dye image-receiving sheet as claimed in claim 6, wherein the back coated layer has a surface roughness (Ra value) of from 0.5 to 2.0 μm determined in accordance with JIS B0601.

8. The dye image-receiving sheet as claimed in claim 6, wherein the thermoplastic resin in the back coated layer comprises at least one member selected from the group consisting of polyolefin resins, polyacetal resins, polyamide resins, and polyvinyl chloride resin.

9. The dye image-receiving sheet as claimed in claim 1, wherein the support sheet has a basis weight of 120 to 160 g/m$^2$ and a thickness of 120 to 160 μm, the front coated layer has a thickness of 15 to 40 μm, the dye image-receiving layer has a thickness of 2 to 15 μm, and optionally the back coated layer has a thickness of 10 to 30 μm.

10. The dye image-receiving sheet as claimed in claim 1, wherein the thermoplastic resin in the front coated layer comprises at least one member selected form the group consisting of polyolefin resins, polyacetal resins, polyamide resins and polyvinyl chloride resins.

11. The dye image-receiving sheet as claimed in claim 1, wherein the resinous material in the dye image-receiving layer comprises at least one member selected from the group consisting of polyester resins, polycarbonate resins, polyacrylic resins and polyvinyl acetate resins.

12. The dye image-receiving sheet as claimed in claim 1, wherein the front coated layer comprises 20% by weight or less of a white pigment mixed with the thermoplastic resin.

* * * * *